US007913753B2

(12) United States Patent
Brink et al.

(10) Patent No.: US 7,913,753 B2
(45) Date of Patent: Mar. 29, 2011

(54) SYSTEM FOR INJECTING A SUBSTANCE INTO AN ANNULAR SPACE

(75) Inventors: David Ian Brink, Doha (QA); Wilhelmus Hubertus Paulus Maria Heijnen, Stromberg (DE)

(73) Assignee: Maersk Olie OG Gas A/S, Copenhagen K (DK)

( * ) Notice: Subject to any disclaimer, the term of this patent is extended or adjusted under 35 U.S.C. 154(b) by 0 days.

(21) Appl. No.: 12/406,632

(22) Filed: Mar. 18, 2009

(65) Prior Publication Data

US 2009/0229813 A1 Sep. 17, 2009

Related U.S. Application Data

(63) Continuation of application No. 11/372,490, filed on Mar. 9, 2006, now Pat. No. 7,523,785.

(51) Int. Cl.
*E21B 43/112* (2006.01)

(52) U.S. Cl. ..... 166/55.2; 166/298

(58) Field of Classification Search ..... 166/55.2, 166/298; 175/78, 322; 409/143; 408/138; 83/185

See application file for complete search history.

(56) References Cited

U.S. PATENT DOCUMENTS

| | | | | |
|---|---|---|---|---|
| 1,962,961 | A | 6/1934 | Carl | |
| 2,381,929 | A | 8/1945 | Schlumberger | |
| 3,153,449 | A | 10/1964 | Lebourg | |
| 3,174,547 | A | 3/1965 | Fields | |
| 3,456,504 | A | 7/1969 | Bombardieri | |
| 3,464,502 | A * | 9/1969 | Ageton | 173/20 |
| 4,417,625 | A | 11/1983 | Henson et al. | |
| 4,714,119 | A | 12/1987 | Hebert et al. | |
| 5,056,595 | A | 10/1991 | Desbrandes | |
| 5,183,111 | A | 2/1993 | Schellstede | |
| 5,195,588 | A | 3/1993 | Dave | |
| 5,238,338 | A * | 8/1993 | Stucky | 409/143 |
| 6,371,221 | B1 | 4/2002 | Harrigan et al. | |
| 6,565,293 | B2 * | 5/2003 | Desmoulins | 408/10 |
| 6,772,839 | B1 | 8/2004 | Bond | |
| 6,915,853 | B2 | 7/2005 | Bakke et al. | |
| 6,955,216 | B1 | 10/2005 | Heijnen et al. | |

FOREIGN PATENT DOCUMENTS

| | | |
|---|---|---|
| GB | 2 283 261 A | 5/1995 |
| GB | 2 397 599 A | 7/2004 |

* cited by examiner

*Primary Examiner* — Shane Bomar
*Assistant Examiner* — Blake Michener
(74) *Attorney, Agent, or Firm* — Brinks Hofer Gilson & Lione

(57) ABSTRACT

A system for injecting a substance into the annular space surrounding a well tubular with an assembly to be inserted into a well tubular. The assembly includes a cutting part capable of making a hole through a well tubular; a substance chamber for storage of the substance and a substance injecting part capable of injecting the substance into the annular space. The system includes a cutting part having a chamber with a first end and a second end and having a wall surrounding the chamber and including at least one entrance for substance at the first end and including an exit for delivery through the well tubular and into the annular space at the second end.

7 Claims, 6 Drawing Sheets

SYSTEM FOR INJECTING A SUBSTANCE INTO AN ANNULAR SPACE

RELATED APPLICATIONS

This application is a continuation of U.S. application Ser. No. 11/372,490, filed on Mar. 9, 2006 now U.S. Pat. No. 7,523,785.

BACKGROUND

The present invention relates to a system for injecting a substance into the annular space surrounding a well tubular.

After a well has been drilled, a well tubular is introduced into the well. Such a well tubular can be a casing or a liner. The outside diameter of the casing is smaller than the inside diameter of the wellbore, providing thereby an annular space, or annulus, between the casing and the wellbore. The well tubular is perforated at one or more zones to allow hydrocarbons to flow into the tubular. Sometimes contaminants such as water or sand are produced along with hydrocarbons from a part of the formations around a well tubular. Therefore it is sometimes required to seal off the well tubular from a part of the annular space containing undesirable contaminants.

To seal off a desired part of for example a casing one technique used is to isolate an internal part of the casing using temporary packers. Cement or other hardenable substance is then pumped down to the isolated zone to seal the perforated openings in the desired part of the casing. If production later on is desired from a zone situated further down in the casing, removal or penetration of the hardened zone is then required.

U.S. Pat. No. 6,955,216 discloses a device for injecting a fluid into an earth formation surrounding a well. The device comprises a body suitable for being arranged in a well bore and provided with a fluid chamber for storage of suitable sealant and a pair of inflatable packers arranged to isolate a portion of the well bore between the packers upon inflating of the packers. The suitable sealant is then injected under pressure into the formation through the perforations isolated between the packers.

BRIEF SUMMARY

In one aspect of the invention, a system is provided for establishing one or more barriers at any position outside a well tubular and providing a substantially free passage within the well tubular. This is achieved by a cutting part having a chamber with a first end and a second end and having a wall surrounding the chamber and including at least one entrance for a substance at the first end and including an exit for delivery of liquid through the well tubular and into the annular space at the second end. The supply of substance through the cutting part leaves the inside of the well tubular more or less untouched by the substance and therefore subsequent drilling out of a hardened zone is no longer required.

In another aspect of the invention, a system is provided, the system having a cutting part that is essentially automatic in operation.

In still another aspect of the invention, a system is provided having a cutting part that is essentially automatic in operation and always applies an essentially constant cutting force to the well tubular.

According to one embodiment of the invention, the system having a cutting part is adapted to cut an essentially circular hole through a well tubular.

According to another embodiment of the invention, the cutting part comprises a first and a second sleeve, the sleeves being interconnected such that a torque applied to the first sleeve provides axial displacement of the first sleeve.

In another aspect, the invention provides a method for injecting a substance into the annular space surrounding a well bore with an assembly to be inserted into a well tubular and having a hole cutting part capable of cutting a hole through a well tubular, a substance chamber for storage of the substance and a substance injecting part capable of injecting substance through substance conducting means within the cutting part and into the annular space, the method comprising the steps of: inserting the assembly into the well tubular; forming a passage through the well tubular and into the annular space by cutting a hole through the well tubular and thereby establishing a substance channel into the annular space; injection of substance through the passage into the annular space surrounding the well tubular to create at least one barrier on the outside of the well tubular and retracting the assembly providing a substantially free passage within the well tubular.

DETAILED DESCRIPTION OF THE DRAWINGS AND THE PRESENTLY PREFERRED EMBODIMENTS

Figure 1:
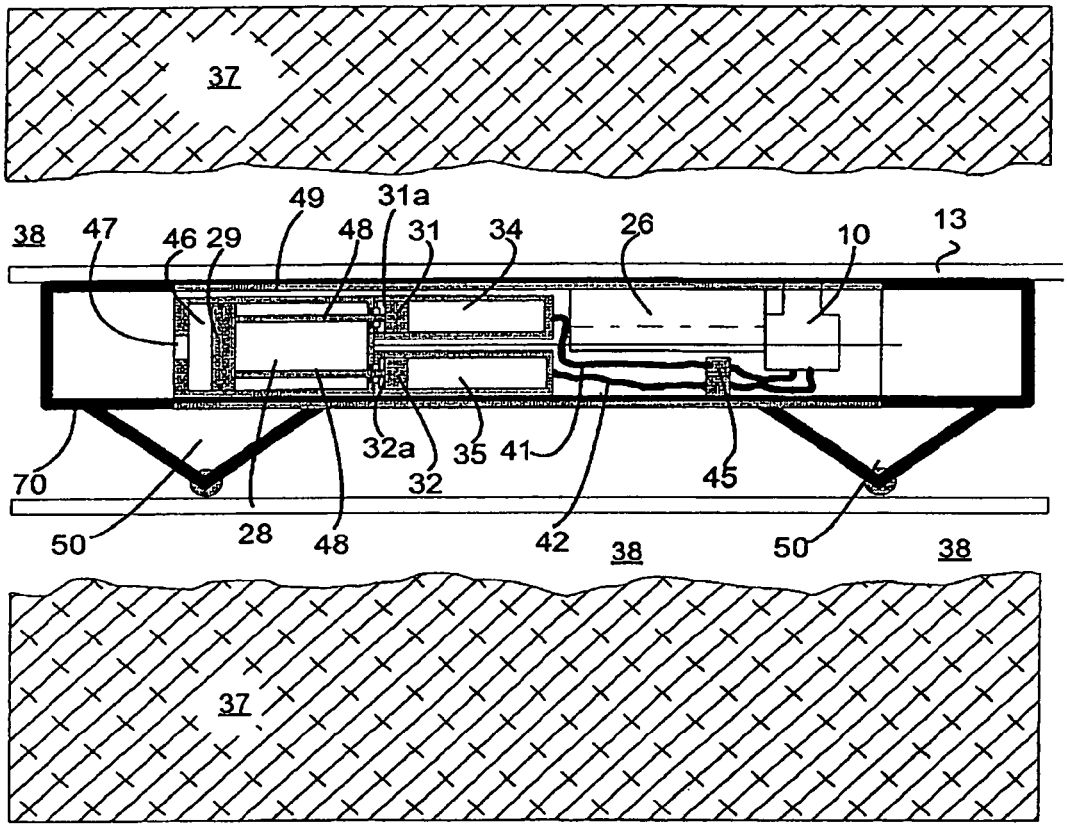
FIG. 1 schematically shows a partial longitudinal section of the assembly inserted in a well tubular.

FIG. 1 is a sectional view of an embodiment of a system for injecting a substance into the annular space surrounding a well tubular. The system is positioned within a carrier 70 which is supported by wheels 50. The carrier is located in a well tubular 13. The outside diameter of the well tubular 13 is smaller than the inside diameter of the wellbore, providing thereby an annular space 38, or annulus, between the well tubular and the formation 37. Normally hydrocarbons are recovered from the surrounding formation through perforations (not shown) in the well tubular and travel to the surface through the well tubular.

However, sometimes undesired elements, as for example sand or water, are produced along with hydrocarbons from a part of the formations around a well tubular. Therefore it is sometimes required to seal off the well tubular from a part of the annular space containing undesirable contaminants. The system according to the invention is capable of creating one or more barriers on the outside of a tubular or pipe.

The system according to an embodiment of the invention shown in FIG. 1 comprises: a carrier 70; a cutting part 10 capable of making a hole through the wall of a well tubular 13; and two substance chambers 34, 35 for storage of substance and a substance injecting part 29, 31, 32. The substance injecting part is capable of injecting the substance through the cutting part once the cutting part is extended through the wall of the well tubular 13 and into the annular space 38 surrounding the well tubular 13.

The substance chamber comprises two cylinders 34, 35. Each cylinder 34, 35 is in substance communication with the cutting part 10 via a separate tube 41, 42. Each tube is provided with a valve 45 for opening and closing of the substance communication between the cutting part and the substance chamber 34, 35.

The substance injecting part comprises two pistons 31, 32 capable of sliding on an internal surface of the cylinders 34, 35. Each piston 31, 32 is connected to a force transmitting piston 29 by piston rods 48. The force transmitting piston 29 is slidably configured within a cylinder 49. Two chambers 28, 46 are provided within the cylinder, one on each side of the piston. The chamber 46 is preferably in substance communication with the well by an opening 47 thereby providing well bore pressure in the chamber 46. The other chamber 28 is sealed off from the well bore and has an internal pressure which is lower than the well bore pressure. The internal pressure can advantageously be established at the surface and the chamber therefore has a pressure which is essentially equal to the surface pressure.

The difference in internal pressure between the two chambers 28 and 46 on each side of the piston 29 provides a force on the piston 29 which entails a pressure in the cylinders which is higher than the well bore pressure as long as the system is in equilibrium.

Once the valves 45 are opened the force exerted by wellbore pressure on the area of piston 29 will exceed the force exerted by wellbore pressure on the pistons 31 and 32, thereby providing movement of the interconnected pistons 29, 31, and 32 and thereby also injecting the substance from the substance chambers 34, 35 via the cutting part 10 and into the annular space 38.

When the piston 29 is fully depressed, the pressure in the chamber 28 will rise due to the reduction in volume. In order to prevent the pressure from rising to a point where it acts against the emptying of the chambers 34 and 35, the chamber 28 can preferably be in substance communication with the back side of the pistons 31 a, 32*a*. Alternatively the chamber 28 may be longer than cylinders 34, 35.

To provide an adequate counterforce and retain the device while the cutting through the wall of the well tubular 13 takes place, the assembly may preferably be provided with at least two retractable/extensible wheel assemblies 50. The wheel assembly 50 also entails an easy insertion (rolling) of the device into the well tubular 13. However, the shown embodiment of the wheel assembly 50 is only one method of securing the device, there are other possible solutions as extending pads and other structures.

Figure 2:
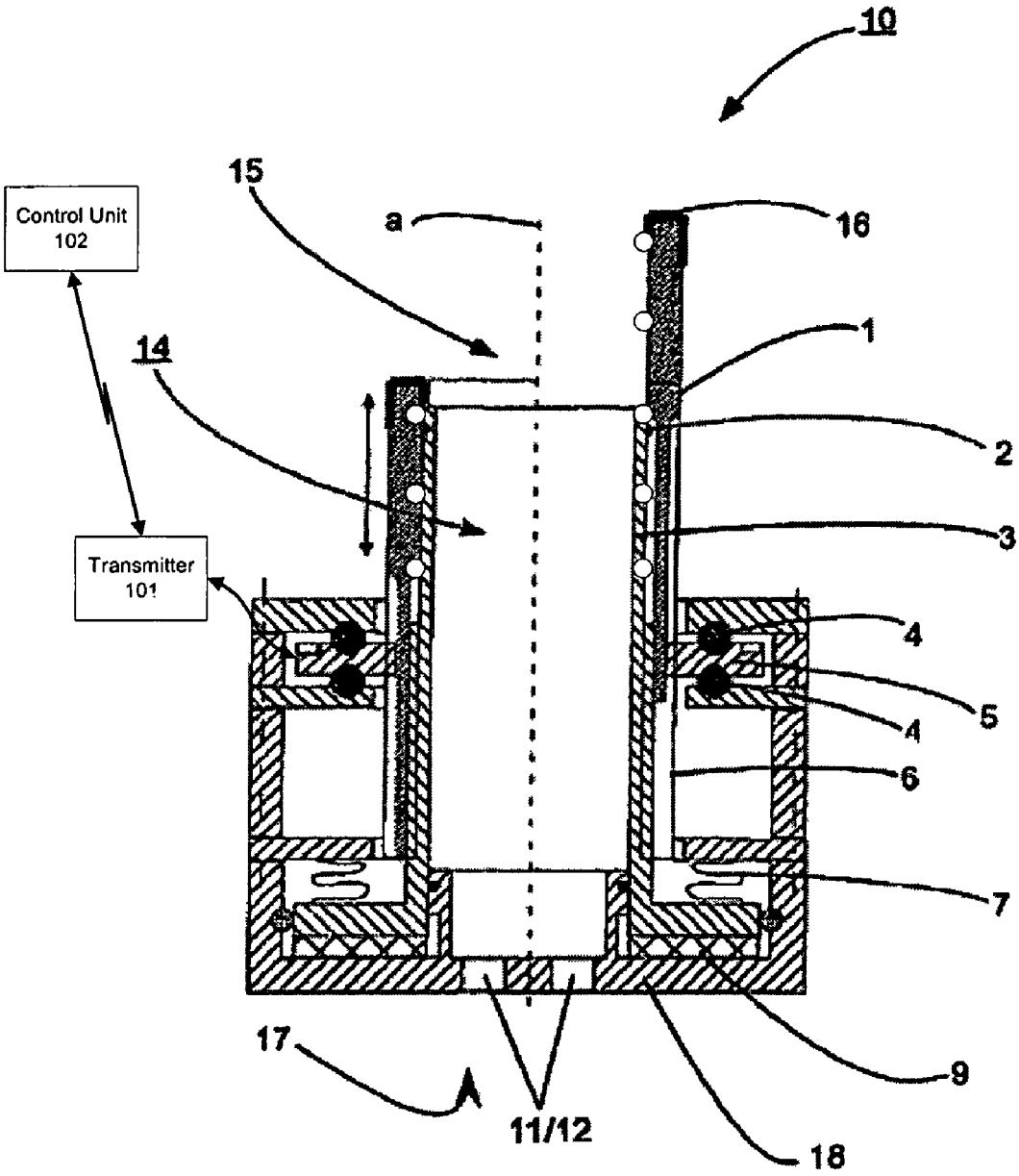
FIG. 2 is a schematic cross sectional view of a cutting part according to an embodiment of the invention, showing the operating principle of the device when cutting.

Turning now to FIG. 2, an embodiment of the cutting part according to the invention is shown. The hollow cutting part 10 is provided with a chamber 14 with a first end 17 and a second end 15 and having a wall 3 surrounding the chamber and including at least one entrance 11, 12 for substance at the first end and including an exit for delivery of substance through the wall of the well tubular and into the annular space at the second end 15.

The right side of the drawing shows, for illustrative purposes only, the cutting part 10 in an extracted position, and the left side of the drawing shows, also for illustrative purposes, the cutting part 10 in a retracted position. The cutting part 10 has a main tool body 18 and comprises two rotatable, concentric sleeves 1, 3 and a motor 26 (not shown in FIG. 2). The sleeve 1 is preferably provided with internal threads for connection with the inner sleeve 3 having outer threads. Each of the two sleeves 1, 3 are able to rotate about a common center axis a. The outer sleeve 1 may preferably be provided with a top 16 of suitable material, such as diamond or carbide, for cutting/grinding into the wall of a well tubular. In the shown embodiment, the outer sleeve 1 is further provided with a gear mechanism 5, which is connected to the motor 26. The gear mechanism 5 may advantageously be supported by ball bearings 4.

In the depicted embodiment, the inner sleeve 3 is connected to the main tool body 18 by a frictional connection 18, 9, 7 which comprises one frictional developing pad 9. The frictional pad 9 is rigidly attached to the inner sleeve 3. The pad 9 is forced against the main tool body 18 by a-spring mechanism 7. The frictional connection 18, 9, 7, which is described in greater details below, ensures rotation of the sleeve 3 when a torque exceeding a given value is applied to the sleeve 3.

The cutting part may preferably comprise a dirt ring 2 between the inner and outer sleeve and in one embodiment the sleeve 1 further comprises a spline 6.

When a motor rotates the gear mechanism 5 in the cutting part 10 according to FIG. 2, the outer sleeve 1 will start to translate due to the relative movement in the threads between sleeve 1 and sleeve 3. If upwards, this translation will continue until sleeve 1 meets a restriction as e.g. the wall of a well tubular wherein a hole is to be cut.

At that point the torque in the system will increase until it reaches a value where the axial load on the outer sleeve causes the frictional pad 9 (between the main tool body 18 and the inner sleeve 3) to slip, causing the inner sleeve 3 to rotate together with the outer sleeve 1 resulting in a grinding/cutting action. This grinding will continue until the axial load on sleeve 1 decreases to a value lower than the given value where the frictional connection slips, causing the inner sleeve 3 to stop rotating and the outer sleeve 1 to travel a little distance further.

Figure 3:
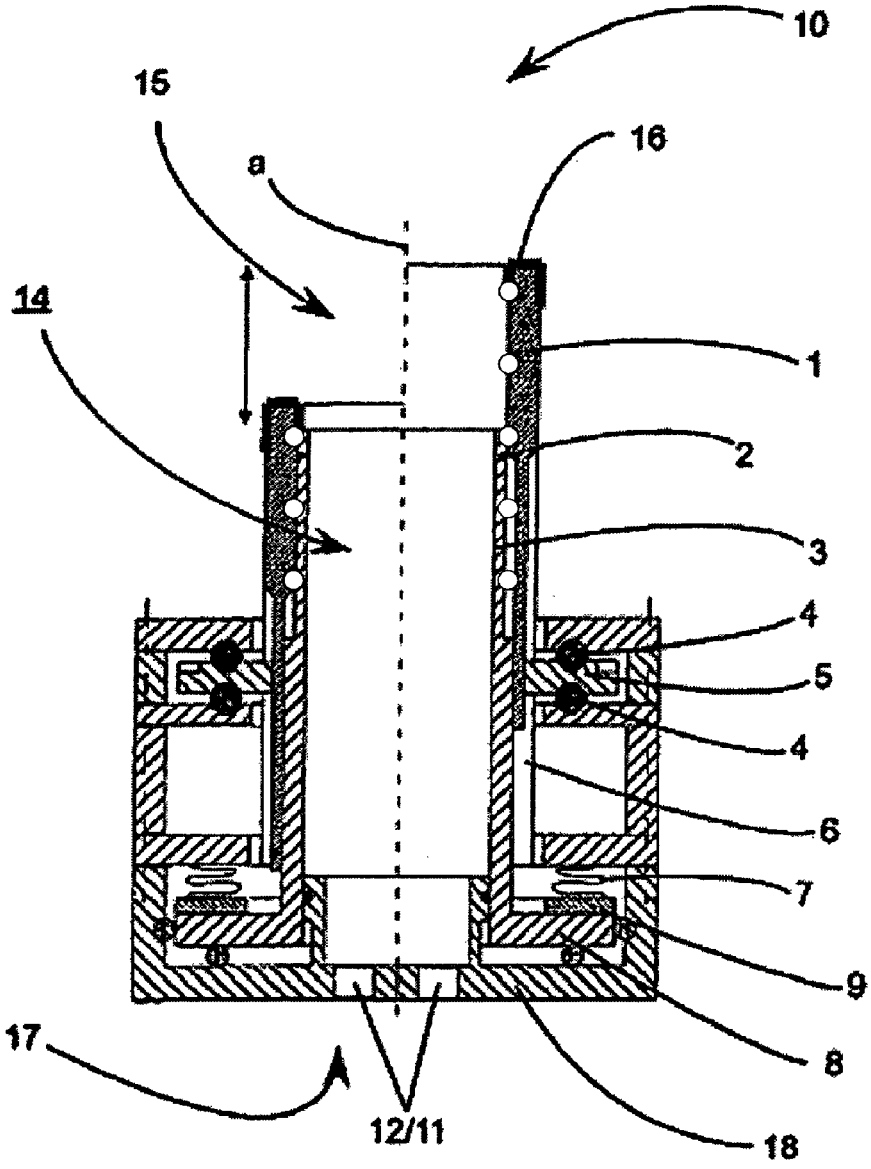
FIG. 3 is a schematic cross sectional view of a cutting part according to another embodiment of the invention, showing the operating principle of the device when cutting into a well tubular.

FIG. 3 shows another embodiment of a cutting part 10 according to the invention. The right side of the drawing shows, as in FIG. 2 and for illustrative purposes only, the cutting part 10 in an extracted position 5 and the left side of the drawing shows, also for illustrative purposes, the cutting part 10 in a retracted position. The cutting part according to this embodiment of the invention also comprises a main tool body 18 and two rotatable interconnected concentric sleeves 1, 3 and a motor 26 (not shown in FIG. 3). The outer sleeve in this embodiment is also provided with a top of suitable grinding material 16 for cutting into a well tubular. However, the frictional connection 9, 3 which allows rotation of the inner sleeve is not, as in the embodiment shown in FIG. 2, situated such that an axial force applied on the inner sleeve and towards the main body increases the frictional force.

In the shown embodiment in FIG. 3, the spring mechanism 7 is pushing the frictional pad 9, which is rigidly attached to the main tool body, towards the top/upper side of a flange 8 on the sleeve 3, thereby providing a frictional connection that has a very constant frictional level and which is also independent of the axial load being applied to the inner sleeve 3 by the outer sleeve 1 during cutting/grinding.

This entails that the slip between the main tool body and the inner sleeve occurs at a very well defined (downwardly) axial force and therefore this embodiment shows a cutting part that always applies an essentially constant and well defined cutting- or grinding force against the well tubular.

Figure 4:
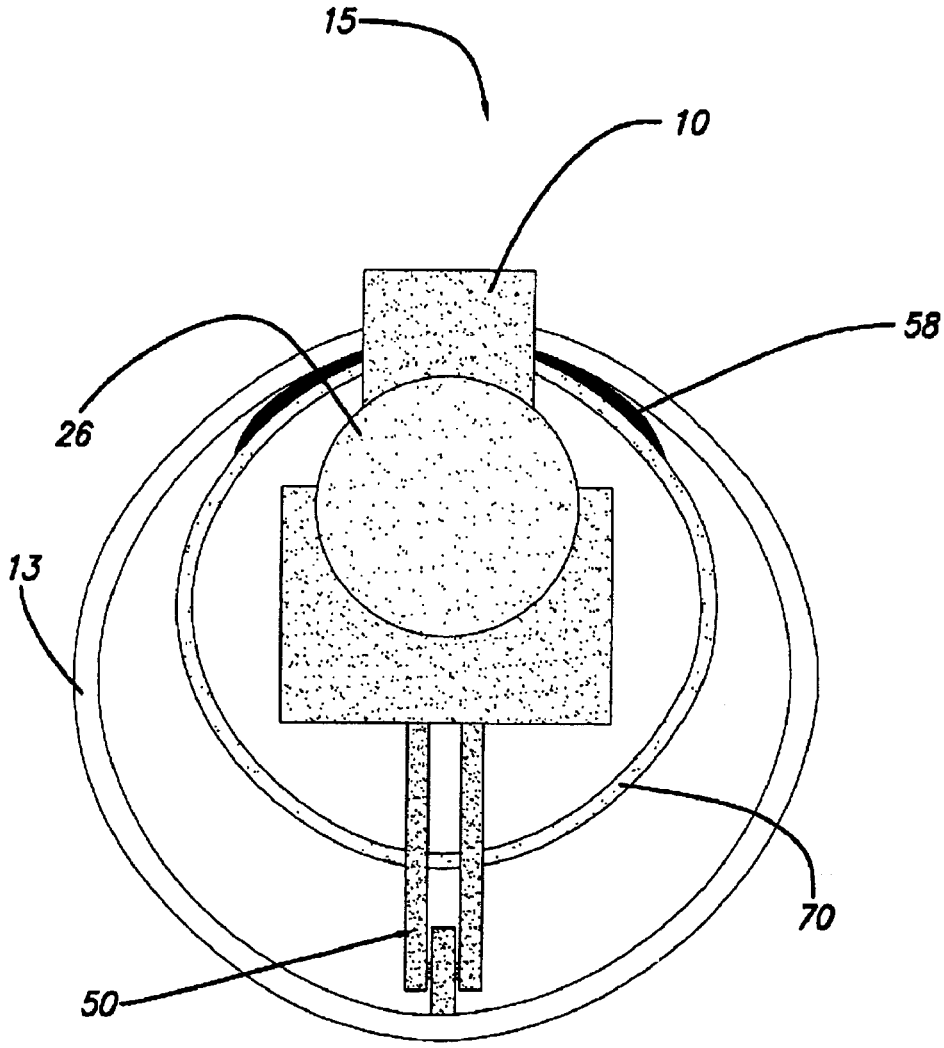
FIG. 4 shows a sectional view of a well tubular with an assembly inserted and the cutting part in an extracted position.

Turning now to FIG. 4, an embodiment of the invention is shown where the system is incorporated in a carrier 70 which is supported by wheels 50. The system is inserted into a well tubular 13 and the wheel assembly 50 is in its extracted position so that the carrier is pushed against the well tubular 13. The cutting part 10 extends through the wall of the well tubular 13 and the carrier 70 is advantageously provided with a seal 58 which prevents leakage of the injected substance between the well tubular 13 and the carrier 70.

Figure 5:
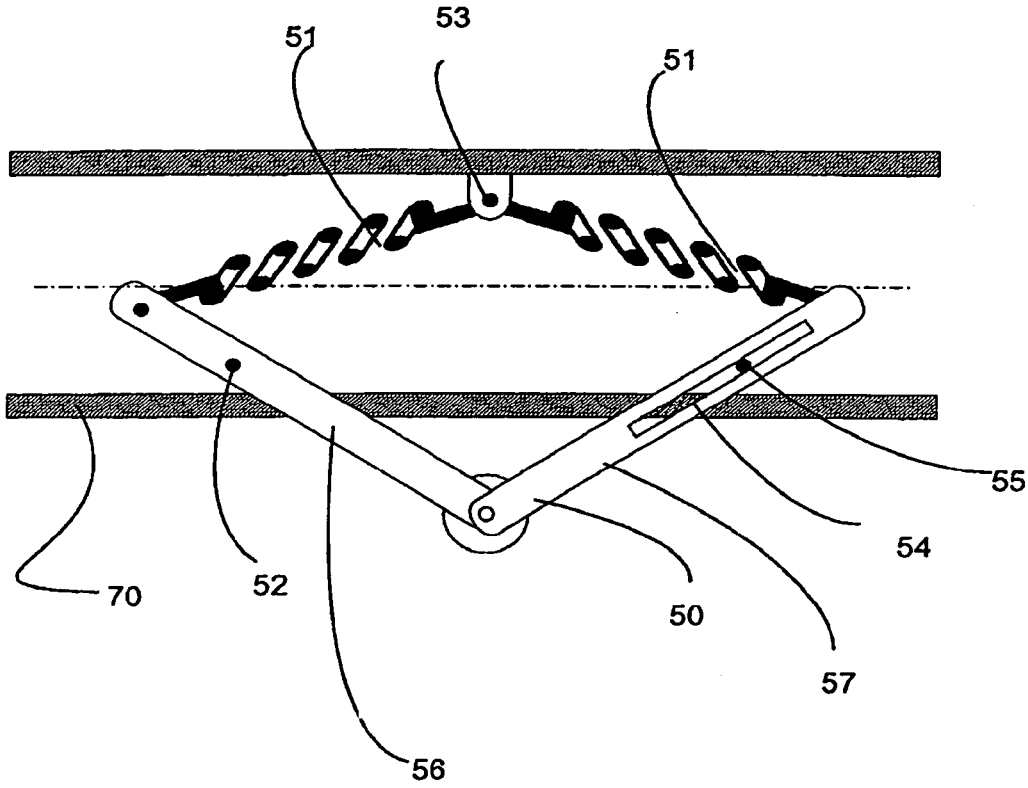
FIG. 5 shows a spring loaded support for the assembly.

FIG. 5 shows a spring loaded support for the assembly 50. The wheel assembly 50 is kept in engagement (extended) with a well tubular (not shown) by a spring mechanism 51. The wheel mechanism 50 comprises in the shown embodiment two legs 56 and 57. Each of the legs 56, 57 is connected to a shared support 53 by a helical spring 51 and each of the two legs 56 and 57 is also rotatably connected to a wheel. Furthermore, the legs 56, 57 are rotatably connected to the carrier 70 by supports 52 55. The two supports 52 and 55 are different in that support 52 (on the left side of the drawing) is rigidly connected to the leg 56 and support 55 is slidably mounted in a slit 54 in the leg 57 thus making the wheel assembly self extending.

Figure 6:
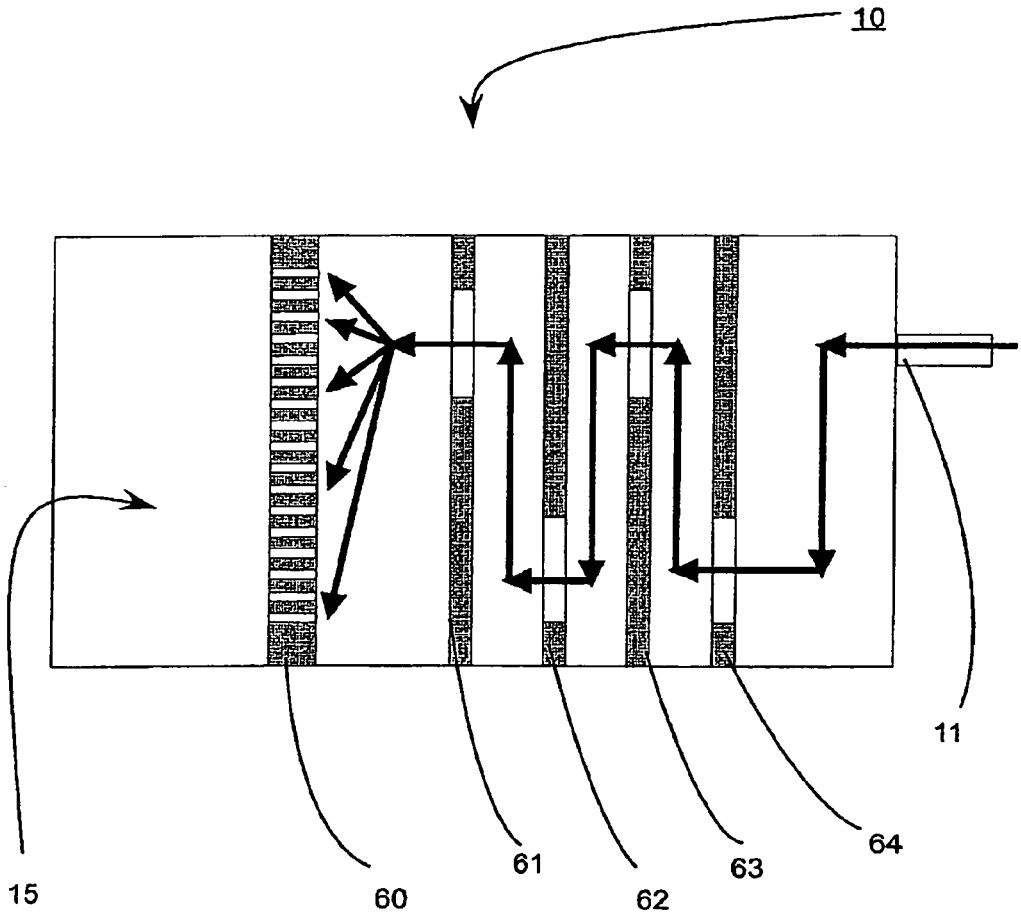
FIG. 6 is a schematic view of a cutting part being equipped with means to facilitate the mixing of substances.

FIG. 6 shows another embodiment of a cutting part according to the invention. The cutting part 10 is provided with internal walls, 60, 61, 62, 63, and 64 which constrain a substance to change direction and speed during its passage through the cutting part. This construction ensures that the substance(s) is sufficiently mixed during its passage through the cutting part 10. The plate 60 facing the exit 15 may advantageously be provided with relatively small holes to ensure a high delivering speed of the substance(s).

Although the cutting part has been discussed in relation to a system having two interconnected sleeves where the outer sleeve extract into grinding contact with the well tubular, the cutting part in another embodiment may instead show an extractable inner sleeve for grinding contact with the well tubular.

When a system according to the invention is used, initially the assembly is inserted and rolled into a well tubular and to a position where a seal has to be made. The position of the device may advantageously be monitored by, for example, a transmitter 101 for receiving and transmitting data from or to a control unit 102, but other suitable means may be used. The assembly may comprise means being adapted for rotation of the carrier so that the carrier can be positioned in any position in the radial plane of the pipe.

Once the assembly has reached the desired position, the motor in the hole cutting part is activated to cut a hole through the well tubular. When the hole is established and while the cutting sleeves extend through the well tubular, one or more substances are injected into the hollow cutting part and further into the annular space thus facilitating mixing of e.g. a two component system prior to its introduction into the annular space.

Once a sufficient amount of substance is introduced into the annular space, the motor may be counter-rotated to retract the sleeve into the cutting part. Having forced a sealing composition into the annular space, the system is removed from the tubular. If many holes are to be drilled, it might be advantageous to finish the substance injection by finally flushing the cutting part with a relatively small amount of non-hardenable substance to prevent obstruction of the cutting part by hardened material.

The system is especially suitable for repairing of wells producing hydrocarbons, but since the overall energy consumption of the device is very low and the device is self-contained (the drilling forces are generated within the cutting part) it is therefore independent of external units. As a result, a barrier outside a tubular can be made in virtually any type of pipe or tubular residing in the ground. It can even be applied to any pipe within an annular space.

It should, however, be noted that the cutting part is able to work and function independently of the other technical features mentioned in the application and it may be independently implemented in many other connections.

It should be noted as well that a substance chamber and a substance injecting part as described above are also able to work and function independently of other technical features.

It is therefore intended that the foregoing detailed description be regarded as illustrative rather than limiting, and that it be understood that it is the following claims, including all equivalents, that are intended to define the spirit and scope of this invention.

The invention claimed is:

1. An assembly for cutting into a well tubular, the assembly comprising:

a main tool body;

a first member having a part being adapted for cutting engagement with the well tubular;

a second member being connected to the main tool body by a frictional connection, wherein the first member and the second member are interconnected by threads and are configured to rotate about an axis; and a motor in mechanical communication with the first member configured to generate a first amount of torque that causes the first member to translate relative to the second member until the first member becomes restricted, and to generate a second amount of torque after the first member becomes restricted, wherein the second amount of torque causes the first member to slip on the frictional connection so that the first member and the second member simultaneously rotate and cut the well tubular.

2. The assembly of claim 1 wherein the first member rotates together with the second member about a common center axis.

3. The assembly of claim 1 wherein the second amount of torque is greater than a frictional force between the frictional connection and the second member.

4. The assembly of claim 3 wherein the frictional connection is configured so that an axial force applied on the first member, the second member or both members and towards the main body increases a frictional force.

5. The assembly of claim 3 wherein the frictional connection is configured so that an axial force applied on the first member, the second member or both members and towards the main body decreases a frictional force.

6. The assembly of claim 5 wherein the first member and the second member further comprise hollow sleeves.

7. The assembly according claim 1 further comprising means to control and measure the displacement of the first member, the second member or both members.

* * * * *